US007252316B2

(12) United States Patent
Wallace et al.

(10) Patent No.: US 7,252,316 B2
(45) Date of Patent: Aug. 7, 2007

(54) ROTATION HOOK

(75) Inventors: Brian E. Wallace, Pleasant Grove, AL (US); James W. Maise, Trussville, AL (US)

(73) Assignee: United States Pipe and Foundry Company, Birmingham, AL (US)

( * ) Notice: Subject to any disclaimer, the term of this patent is extended or adjusted under 35 U.S.C. 154(b) by 0 days.

(21) Appl. No.: 10/402,902

(22) Filed: Mar. 26, 2003

(65) Prior Publication Data

US 2004/0189032 A1 Sep. 30, 2004

(51) Int. Cl.
*B66C 1/34* (2006.01)

(52) U.S. Cl. ..... 294/82.1; 294/1.1

(58) Field of Classification Search ..... 294/82.1, 294/82.11, 82.12; 43/5; 114/294
See application file for complete search history.

(56) References Cited

U.S. PATENT DOCUMENTS 862,285 A 4/1907 Murray
1,320,723 A * 11/1919 Wood et al. ..... 294/82.1
1,502,781 A * 7/1924 Jamison ..... 43/43.16
2,414,092 A 1/1947 Charwinsky
2,490,583 A * 12/1949 Dunkelberger ..... 43/44.82
3,002,780 A 10/1961 Eggeman
3,092,412 A * 6/1963 Drake ..... 294/66.1
3,863,441 A 2/1975 Kaufmann
4,019,770 A 4/1977 Poelma
4,108,484 A * 8/1978 Malroit ..... 294/66.1
4,402,119 A 9/1983 Peterson
4,652,033 A * 3/1987 McLoughlin ..... 294/82.1
5,875,584 A * 3/1999 Gowing ..... 43/44.82
6,823,565 B2 * 11/2004 Toye ..... 24/265 H

* cited by examiner

*Primary Examiner*—Gene O. Crawford
*Assistant Examiner*—Esther Onyinyechi Okezie
(74) *Attorney, Agent, or Firm*—Bradley Arant Rose & White LLP; John W. Smith T

(57) ABSTRACT

A device for lifting and rotating objects is disclosed. The device includes a plurality of hooking protrusions that are in angled relation with each other and contain compound bends to permit engagement with the support structure of the object to be lifted.

15 Claims, 3 Drawing Sheets

ROTATION HOOK

BACKGROUND

This invention relates generally to devices for lifting objects. More particularly, this invention is directed towards crane hooks used to lift heavy objects in a manufacturing setting.

Devices such as cranes and other overhead hoists are common in industrial and manufacturing plants. Such devices are used primarily for lifting and manipulating heavy objects from a first position to a second position in a manufacturing facility or on a construction site.

Some crane devices, commonly referred to as bridge cranes, are positioned on rails suspended over a manufacturing plant floor. The hoisting device moves back and forth along a bridge that spans the rails, and the bridge itself is able to move forward and backwards along the rails. Such cranes are usually equipped to lift extremely heavy objects and move such objects within the generally rectangular area defined by the suspended crane rails and the bridge traversing the crane rails. Often, such overhead cranes are used to move objects back and forth, repetitiously, from one station in the manufacturing process to a second station located within the area serviced by the overhead crane.

Most overhead cranes or other hoists have a hooking element that can be raised or lowered as needed. The hooking element is normally positioned over the object to be transported and is then lowered to an appropriate level for attachment to the object. The hooking element and the attached object are then raised and moved from the first position to the second position in the manufacturing facility. Often, the hooking element is attached to the crane in such a manner as to minimize twisting of the object while it is being lifted. For example, the hooking element may be attached at the end of a cable and pulley system, or reeve, which acts to resist the twisting forces that naturally act on an object as it is lifted from the ground. While an object may initially and naturally turn slightly from its initial position as it is lifted from the ground, the reeving system will apply resistance to cause the object on the hooking element to return to its initial, fixed position. The more stable configuration of the hooking element improves the ability of the crane operator to control the object being lifted.

Often times, it is desired to rotate or manipulate the object in a controlled fashion as the object proceeds between the various stations in the manufacturing process. It will be appreciated that this can usually be most efficiently accomplished while the object is suspended, between its point of departure and its destination. When controlled rotation of the object is desired, it is usually necessary to equip the overhead crane with special machinery to achieve the required rotation of the hooking element. The current practice used to rotate heavy objects to a specific orientation often involves powered mechanized equipment installed on or near the point of attachment of the hooking element to the crane cables, sometimes referred to as the rotating hook block, which is also proximate to the point of attachment to the object being transported. However, these motorized devices, which have moving parts, require frequent maintenance and are often not ideal for handling certain objects such as those that radiate intense heat such as open-top ladles containing molten iron or steel. The extremely high temperatures emitted from the molten metal can cause maintenance and reliability problems for the machinery that is attached to the crane and used to rotate the object.

Alternatively, the object can be manually manipulated using rigging devices such as slings or chains. However, manual manipulation is time consuming and makes the manufacturing process less efficient. In addition, manual manipulation can subject the operators to safety risks. For example, the intense heat of certain objects being lifted and manipulated poses safety concerns to those who would be exposed to the heat while rotating the object. There is, as a result, a need for a device that can accomplish the controlled rotation of objects being lifted, particularly objects of extremely high temperatures.

As suggested by the foregoing discussion, an exemplary and non-exclusive alternative object of this invention is to permit a remote crane operator to lift an object such as a container of molten metal or other potentially hazardous load in one orientation and to rotate the object to a different, predetermined orientation without manual intervention or the use of powered mechanized equipment. Although the device will have common application with all types of cranes, it is expected that the device can be used in various other lifting applications.

The above objects and advantages are neither exhaustive nor individually critical to the spirit and practice of the invention. Other or alternative objects and advantages of the present invention will become apparent to those skilled in the art from the following description of the invention.

BRIEF SUMMARY OF THE INVENTION

The present invention was developed in connection with a manufacturing facility in which ladles of molten metal are transported by crane from a first manufacturing station to a second manufacturing station. Generally, the ladle is filled with molten metal at the first station and is lifted by the overhead crane and transported to a second station. The molten metal is emptied at the second station by way of a spout on the ladle which must interface with the second station. The empty ladle is then returned by the crane to the first station and the process is repeated. The limited floor space in the facility requires that the stations be oriented such that the ladle must be rotated approximately 90° while in route between stations in order for the ladle to interface properly with each station. Thus, in the present application using the invention, each ladle is lifted from the first station by the device attached to a crane which causes natural forces to rotate the ladle approximately 90° prior to placement of the ladle at the second station. After the ladle has emptied its contents at the second station, it is lifted and is rotated by the device approximately 90° in the opposite direction as compared to the first rotation, so that, when the ladle is returned to the first station, it has returned to its original position.

The present invention may be basically described as a lifting device made with a plurality of hooking protrusions oriented at lateral angles relative to each other, with one or more of the protrusions having a compound bend facilitating entry into the support structure or handle of the object to be transported. The invention has no moving parts but rather relies on gravity and the dynamics of lifting to cause the object to rotate to a desired orientation as the object is lifted off the ground. Each hooking protrusion can be formed to cause 0 to approximately 90° rotation in an intended direction.

The device can be made of varying sizes. A rigid material that can support substantial loads in extreme environments, such as high heat, is preferred. In one preferred embodiment, a solid steel bar, of either round or rectangular cross-section, is used. The specific configuration should be adequately sized to accommodate the loads and required lifting cycles according to accepted engineering standards and practices. Exact material specifications should be chosen to produce adequate strength and durability for the required loads (static and dynamic) and lifting cycles. The number of hooking protrusions and their respective orientations as to each other depends on the specific lifting application, particularly the desired rotations or orientations of the object to be lifted and moved.

DETAILED DESCRIPTION OF THE INVENTION

The following is a detailed description of the invention. Those skilled in the art will understand that the specificity provided herein is intended for illustrative purposes with respect to the inventor's preferred and most preferred embodiments, and is not to be interpreted as limiting the scope of the invention.

The rotation hook comprises a sturdy neck portion 1 terminating in a first, or upper, end 2 capable of being attached in a substantially restrained manner to a means for lifting or pulling, such as an industrial crane, By substantially restrained, it is intended that the device, upon attachment to the crane, will resist twisting forces that may naturally occur as the crane lifts objects and loads. Although some twisting movement may occur initially, it is intended that the device be affixed to the crane in a manner that the device itself resists such twisting movement and tends to return to its pre-engagement orientation should twisting movement of the device occur upon engagement with the object to be lifted. For example, cable and pulley systems are often employed in industrial cranes and achieve the result herein described. It will be appreciated that this is a designed and existing function with most standard crane hoists and blocks and other means for attaching hooking elements to cranes and is not a novel feature of the instant invention. In the preferred embodiment shown in FIG. 1, said attachable first end 2 forms a loop or "eye" 3 through which a crane hook or other mode of attachment, depicted in FIGS. 6 and 7, can engage the device, usually for lifting.

Figure 1:
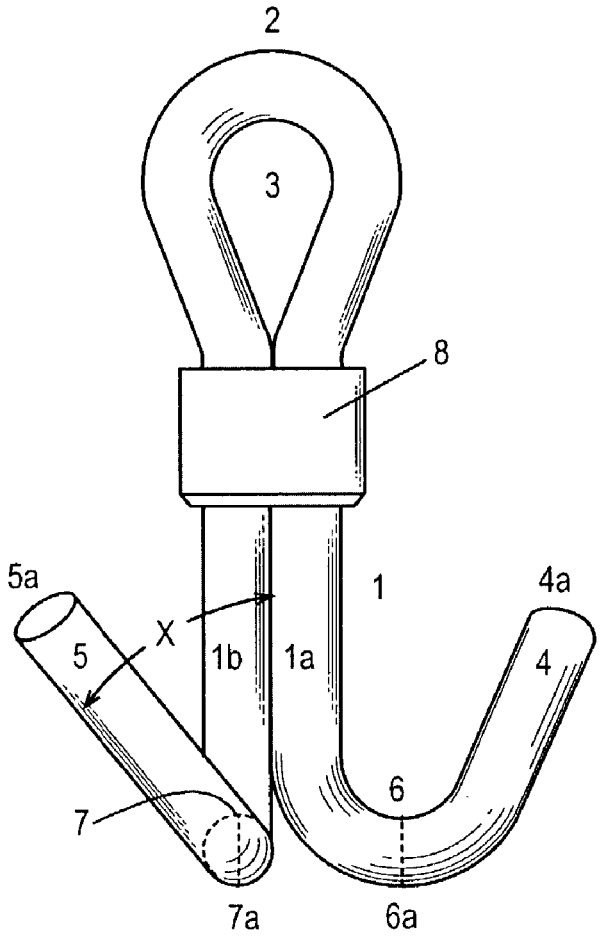
FIG. 1 is a three dimensional perspective view of the invention.
Figure 2:
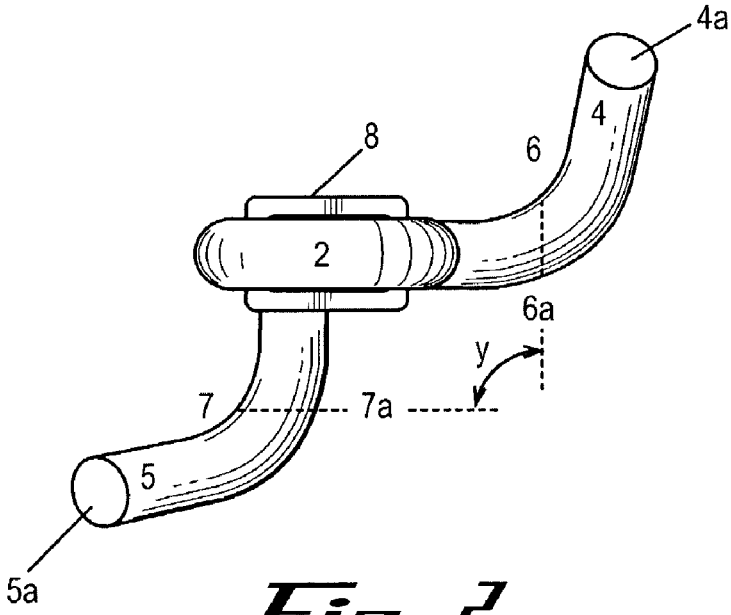
FIG. 2 is a top plan view of the invention.

A plurality of hooking protrusions 4 and 5 extend from the second, or lower, end portion of neck 1. The instant application depicts the device as having two protrusions, but additional protrusions can be added to allow additional rotation possibilities as will be more fully described below. The respective intersections of the lower end of neck 1 and each protrusion comprise curved portions 6, 7 which are described in greater detail below. Said protrusions are fashioned to permit engagement of supporting structures of the object to be lifted by the crane device. As will be readily understood by reference to FIG. 1, in the preferred embodiment, at least one of said protrusions, 5, has a compound bend resulting in an offset of the protrusion 5 relative to the centerline of neck portion 1. In FIG. 2, it will be seen that both protrusions 4 and 5 have compound bends resulting in the offset. Typically, the entirety of a hook protrusion lies in the same plane as the centerline of the neck portion of the hook. As is apparent from FIG. 1, in the present invention, the added or compound bend results in protrusion 5 extending at an angle X relative to the centerline of neck portion 1. The utility of the offset will be more readily understood once the nature of curved portions 6, 7 are described.

In the disclosed embodiment depicted in FIGS. 3, 4, 5, 6 & 7, the object to be lifted is a ladle 10 having a spout 14. Said ladle 10 has supporting structure, or bail handle 11, which is generally an upside down "U" or "V" shape and which will receive protrusions 4 or 5. It will be appreciated that the dimensions of protrusions 4 or 5, including their length and any offset, will depend on the nature of the object to be lifted and the support structure to be engaged. The length of each protrusion must be sufficient to restrain the object once it is lifted. The offset angle X should be sufficient to facilitate entry of the offset protrusion into the space beneath the handle. In the preferred embodiment, the offset angle is about 40° relative to the centerline of neck 1, as shown in FIG. 1.

Figure 3:
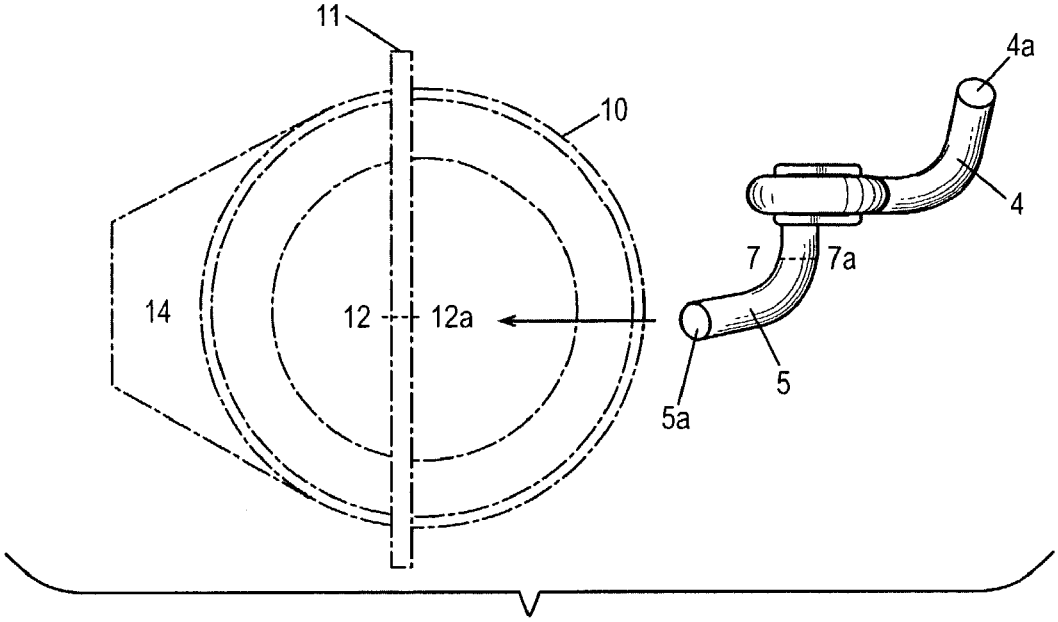
FIG. 3 is a top plan view of the invention as it approaches a ladle.
Figure 7:
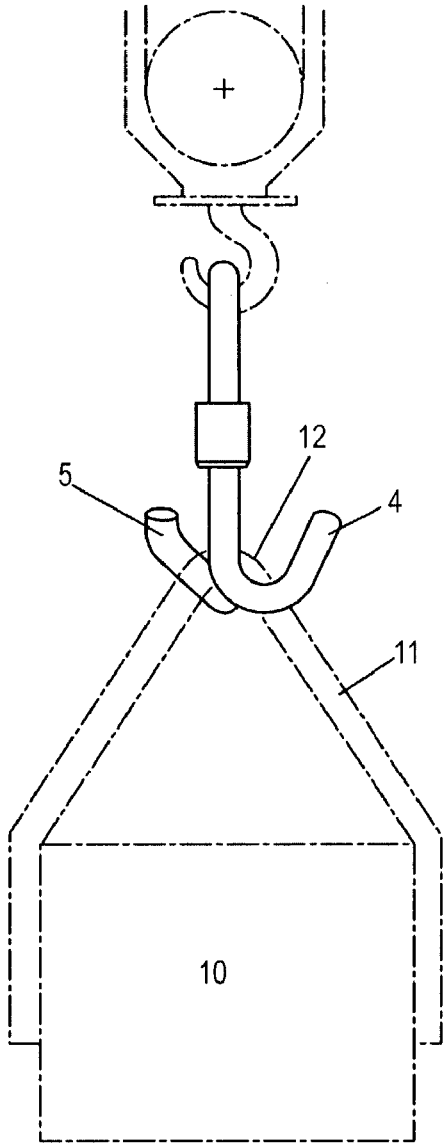
FIG. 7 is a side elevation view of the invention lifting a ladle.

It will be appreciated that the offset angle X can be adjusted to achieve improved engagement with handle 11. Referring to FIGS. 3 and 7, handle 11 has cross section 12-12*a* generally at its upper portion 12 which will be in contact with the device upon being lifted from the ground. It is expected that most support structures will have a cross section of generally uniform shape and dimension throughout the entire length of said support structure, although this is not necessarily required. It is further anticipated that the cross sections of most support structures will be circular in nature, but other shapes are anticipated.

As stated, bended portions 6, 7 are fashioned for accommodating handle 11 after it has been engaged and lifted by the device. It will be appreciated that the weight of the object 10 will force handle 11 to slide down the protrusion such that the upper most portion 12 of handle 11 will engage the lowest points of bended portions relative to ground level as object 10 is lifted off the ground. Bended portions 6 and 7 are fashioned such that, in a suspended state, each has a cross section at its lowest point relative to ground level, noted respectively in FIG. 1 along the reference lines 6-6*a* and 7-7*a*, which lie within planes intersecting at an angle. Put differently, protrusion 4 and 5 are not in parallel. As best shown in FIG. 2, the angle of intersection is designated Y. Angle Y generally determines the amount of rotation of the object that will be achieved upon lifting by one protrusion relative to lifting by the other protrusion of the device making up angle Y. In the preferred and disclosed embodiment, angle Y is 90°, thereby permitting a 90° rotation of the object as it is being lifted, relative to the lifting by the other protrusion.

As shown in FIG. 3, rotation occurs by utilizing the protrusion which, prior to engaging the support structure, has a cross section at its lowest point that is parallel to cross-section of the upper portion of handle 11. In FIG. 3, protrusion 5 is shown engaging handle 11. Cross section 7-7*a* of protrusion 5 is, at the initial point of engagement, in parallel with cross-section 12-12*a* of handle 11. Typically, engaging handle 11 with a hooking protrusion that is "in parallel" with the handle would be difficult to impossible.

However, because of the afore-described offset of the hooking protrusion, the instant device overcomes this problem.

Figure 4:
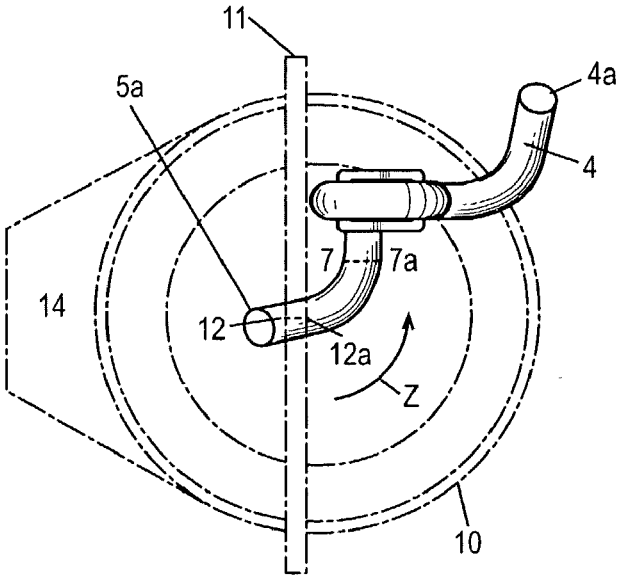
FIG. 4 is a top plan view of the invention as it engages the ladle before the ladle is caused to rotate.

This will be more easily understood by referencing FIGS. 3-5, as use of the present device will now be described. An overhead crane having device 1 approaches object 10 having handle 11 extending in generally upward fashion. As the crane moves overhead object 10, the device is lowered to the appropriate level and a protrusion is caused by the crane operator to pass through handle 11. As shown in FIGS. 3 and 4, other protrusions could be utilized, but protrusion 5, having cross section 7-7*a* in parallel with cross section 12-12*a* of handle 11 is selected in order to cause the object to rotate. It will be appreciated that standard hooks, having a protrusion that extends in the same plane as the centerline of the neck portion of the hook, would not be able to grasp the handle if the protrusion is generally parallel to the plane of said handle. By fashioning the compound bend in the protrusions of the instant device, the previously described offset is achieved as tip 5*a* is able to pass through handle 11, thus achieving engagement. As the crane begins lifting object 10, protrusion 5 engages the upper most point 12 of support structure 11, forcing support structure 11 and object 10 to rotate through in the direction indicated by arrow Z, shown in FIG. 4, until cross section 12-12*a* of the upper portion of support structure 11 is perpendicular with cross section 7-7*a* of the lowest point of bend 7.

Figure 5:
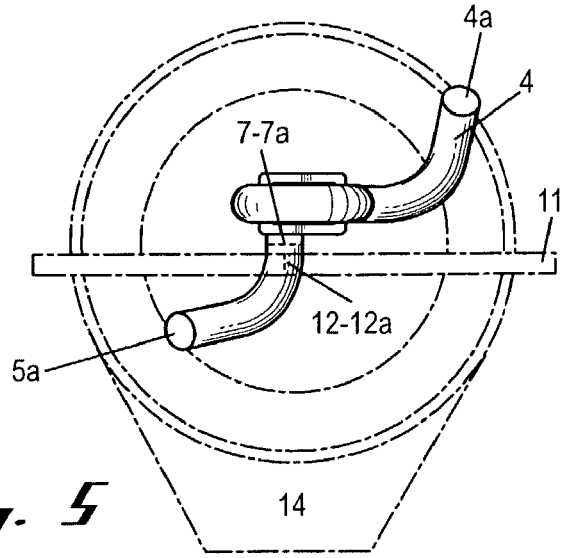
FIG. 5 is a top plan view of the invention that has lifted and rotated the ladle.
Figure 6:
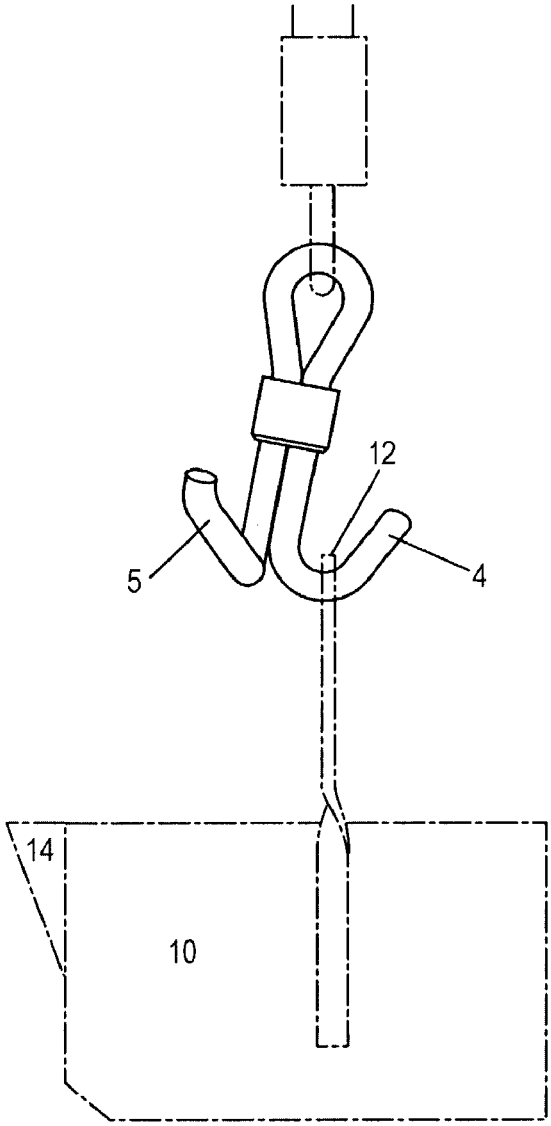
FIG. 6 is a front elevation view of the invention lifting a ladle.

As depicted in FIG. 5, the object now fully rotated, can interface with the second station in the manufacturing process. Referring to FIG. 6, it will be readily understood that the reverse rotation of the object can be obtained during the return trip from the second station to the first station by utilizing protrusion 4. Additional rotation of the object can be achieved by utilizing additional hooking protrusions with bends having cross-sections at their lowest points in planes at varying angles. There will be instances when the operator wishes to lift the object without causing the object to rotate, and therefore, in one preferred embodiment of the invention, this may be achieved by providing a protrusion having a cross-section at its lowest point perpendicular to the cross-section of the upper portion of the handle. Referring to FIGS. 2 and 3, an operator wishing to lift object 10 without causing rotation would employ protrusion 4 which has a cross section 6-6*a* perpendicular to cross-section 12-12*a* of handle 11.

As is apparent from the drawings, in the preferred embodiment, the device can be fashioned from a single piece of metal that is shaped to form the various bends and angles previously described. In the preferred embodiment, the metal is shaped such that neck portion 1 actually comprises two lengths, 1*a* and 1*b* of the metal that are secured together by collar 8. It is contemplated that other manufacturing means, such as welding or the use of fasteners, can achieve the device with the same basic features. However, it will be appreciated that fashioning a single piece of material, as disclosed, generally provides superior strength over welding or other fastening means.

We claim:

1. A device for lifting and rotating objects comprising:

(a) neck portion;

(b) plurality of protrusions extending upwardly from said neck portion such that the respective intersections of said protrusions and said neck portion form curved portions, at least two of said curved portions having planar cross sections at the respective bottom most point of said curved portions intersecting at a predetermined angle such that, upon lifting, said object will rotate relative to said device about said object's vertical axis by an amount determined by said angle while said device remains in a substantially constant orientation; and (c) at least one of said protrusions is offset in relation to the centerline of said neck.

2. The device of claim 1, wherein:

(a) said neck is connectable to a lifting means in a substantially restrained manner.

3. A device for lifting and rotating an object comprising:

(a) neck portion having a top end and a bottom end, said top end connectable to a lifting means in a substantially restrained manner; and (b) plurality of protrusions extending from said bottom end of said neck portion in generally upward fashion such that the respective cross sections at the intersections of at least two of said protrusions and said neck portion lie in planes intersecting at an angle predetermined for accomplishing the rotation of said object relative to said device which remains substantially in pre-engagement orientation, and at least one of said protrusions extends from said neck portion in offset fashion.

4. The device of claim 3, wherein:

(a) said angle is about 90 degrees.

5. The device of claims 1, 2, 3 or 4 wherein:

(a) said device is fashioned from a single piece of metal.

6. The device of claims 1, 2, 3 or 4 wherein:

(a) said neck portion comprises two lengths of a single piece of metal secured by a collar.

7. A method for lifting and rotating an object about said object's vertical axis comprising the steps of:

(a) approaching the object to be lifted with a hook comprising (i) a neck portion;

(ii) a plurality of lifting protrusions extending from said neck portion in generally upward fashion, at least two of said protrusions having cross sections at their respective bottom-most points lying in planes intersecting at an angle predetermined for accomplishing the rotation of said object, and at least one of said protrusions extending from said neck in offset fashion;

(iii) said neck portion connectable to lifting means in a substantially restrained manner;

(b) engaging the object to be lifted with one of said protrusions having a cross-section at its bottom-most point in non-perpendicular relationship with the cross-section of the object at the point of the object to be engaged for lifting; and (c) applying a lifting force to said hook causing the object to rotate relative to said device which remains in a substantially constant orientation such that the cross-section of the object at the point of engagement with said protrusion is about in perpendicular relationship with the cross-section of said protrusion at said point of engagement.

8. A method for lifting and rotating an object about said object's vertical axis comprising the steps of:

(a) approaching an object with a substantially restrained hook having a neck and a plurality of hooking protrusions, at least one of said protrusions being offset from the centerline of said neck;

(b) engaging said object with said offset protrusion having at its lowest most point a cross section in a plane that is about parallel with the plane of the cross-section of the portion of the object to be engaged; and (c) applying a lifting force to said hook causing the plane of the cross-section of the portion of said object to rotate until it is about perpendicular with the plane of the cross-section of said lowest most point of said protrusion of said device which remains in a substantially restrained orientation.

9. The device of claim 1 wherein:

(a) said angle is about 90 degrees.

10. The method of claim 7 wherein:

(a) said angle is about 90 degrees.

11. A device for lifting and rotating an object comprising:

(a) neck portion; and (b) plurality of protrusions extending from said neck portion in generally upward fashion such that the planar cross section at the bottom most point of a first of said protrusions is in parallel relationship with the planar cross section at the point on the object to be lifted, said protrusion being offset from the centerline of said neck portion to facilitate engagement with the object to be lifted and rotated relative to said device which remains in a substantially constant orientation.

12. The device of claim 11, wherein:

(a) the planar cross section at the bottom most point of a second of said protrusions intersects said planar cross section at the bottom most point of said first protrusion at a predetermined angle.

13. The device of claim 12, wherein:

(a) said angle is about 90 degrees.

14. A device for lifting and rotating an object comprising:

(a) neck portion;

(b) plurality of protrusions extending from said neck portion in generally upward fashion, at least one of said protrusions being axially offset from said neck portion to facilitate engagement with object to be lifted; and (c) lifting means connectable to said neck portion of said device such that rotation of said device itself is substantially resisted and said device naturally returns to pre-engagement orientation as the lifted object rotates to a new pre-determined orientation relative to said device.

15. The device of claim 14, wherein:

(a) said new pre-determined orientation of said object is about 90 degrees relative to said object's pre-engagement position.

* * * * *